US006041633A

United States Patent [19]

Bieling

[11] Patent Number: 6,041,633

[45] Date of Patent: Mar. 28, 2000

[54] FORMING APPARATUS

[75] Inventor: Peter Bieling, Nalbach, Germany

[73] Assignee: Anton Bauer Werkzeug- und Maschinenbau GmbH & Co. KG, Dillingen, Germany

[21] Appl. No.: 09/154,725

[22] Filed: Sep. 17, 1998

[51] Int. Cl.[7] ..... B21D 22/10

[52] U.S. Cl. ..... 72/61; 72/58

[58] Field of Search ..... 72/58, 61, 62, 72/60

[56] References Cited

U.S. PATENT DOCUMENTS

| | | | |
|---|---|---|---|
| 4,317,348 | 3/1982 | Halene et al. | 72/62 |
| 5,419,171 | 5/1995 | Bumgarner . | |

FOREIGN PATENT DOCUMENTS

| | | | |
|---|---|---|---|
| 497438 | 7/1992 | European Pat. Off. | 72/58 |
| 1370852 | 6/1963 | France . | |
| 1777176 | 1/1966 | Germany . | |
| 4432692 | 3/1996 | Germany . | |
| 22423 | 2/1980 | Japan | 72/58 |
| 82229 | 5/1985 | Japan | 72/58 |
| 96333 | 5/1985 | Japan | 72/61 |
| 653006 | 3/1979 | U.S.S.R. | 72/61 |
| 1176994 | 9/1985 | U.S.S.R. | 72/58 |
| 1433527 | 10/1988 | U.S.S.R. | 72/58 |

*Primary Examiner*—David Jones
*Attorney, Agent, or Firm*—Friedrich Kueffner

[57] ABSTRACT

The invention is directed to a forming device, especially internal high-pressure forming device, with a multiple-part forming tool and a clamping device which holds the parts of the forming tool together against the deforming action. In the novel forming device, according to the invention, the clamping device and/or the forming tool have/has at least one counter-clamping device which compensates at least partially for deformations of the mold cavity during forming. The possibility of compensation according to the invention makes it possible to construct the clamping and/or forming tool parts in a less solid manner.

18 Claims, 1 Drawing Sheet

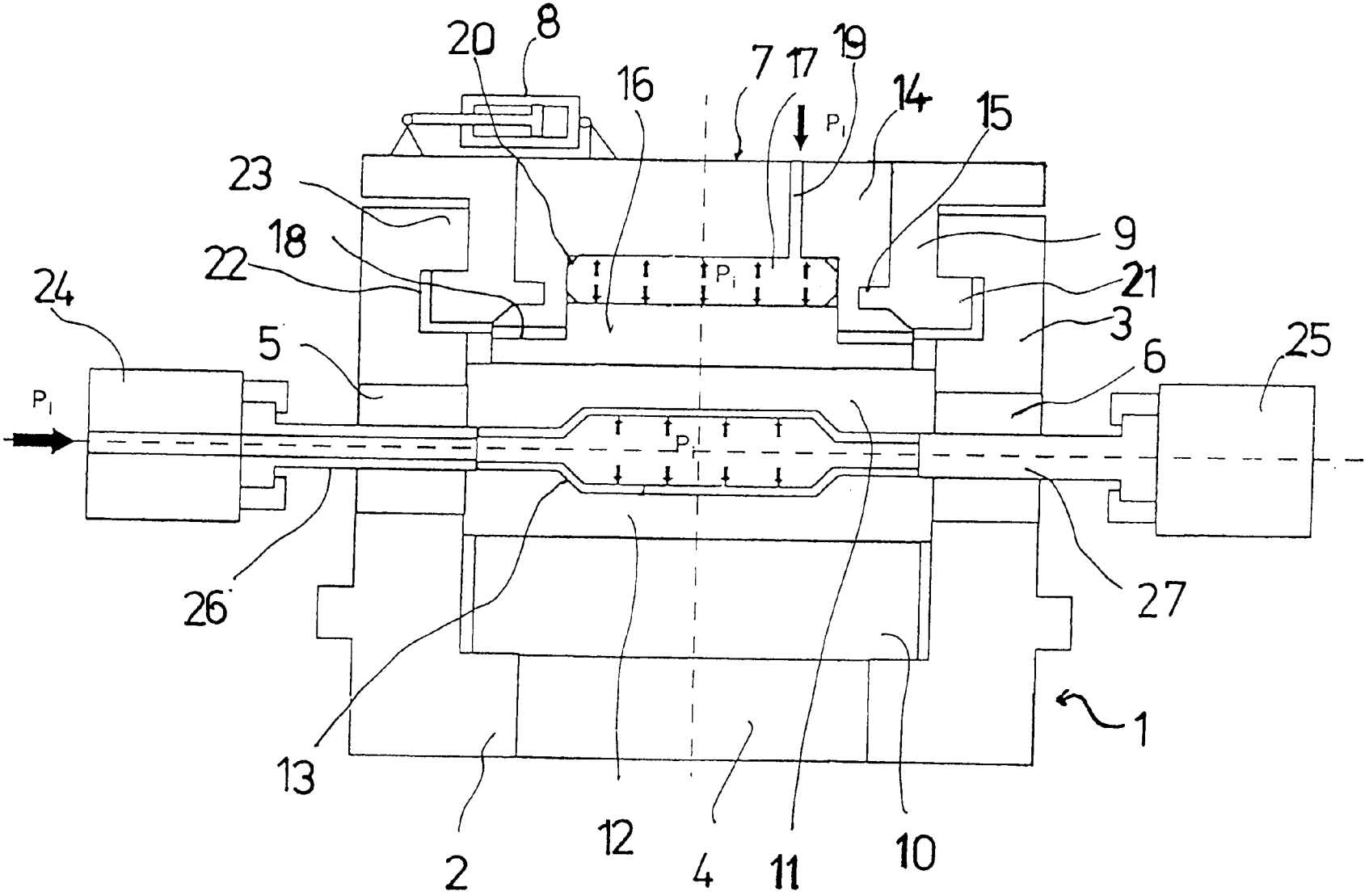
25
27
1
6
3
21
9
15
14
19
17
7
10
11
4
12
2
13
26
5
22
18
23
16
8
20
24
$P_1$

FORMING APPARATUS

BACKGROUND OF THE INVENTION

1. Field of the Invention

The invention is directed to a forming device, especially to an internal high-pressure forming device, with a multiple-part forming tool and a clamping device which holds the parts of the forming tool together against the deforming action.

2. Description of the Related Art

In internal high-pressure forming, strict requirements must be set for the strength of the clamping of the forming tool parts and of the forming tool itself. Especially in the end phase of production of a formed article in which the formed article workpiece substantially rests against the forming walls of the tool mold cavity, the very high working pressure required for complete forming of the workpiece is transmitted to the tool and clamping device. However, in spite of this high loading, no deformations of the mold cavity impairing the dimensional stability of the formed article should come about, e.g., in that clamping jaws holding together tool parts of the forming tool give way by expansion of the mold cavity. Tools and clamping devices of internal high-pressure forming devices of this kind must be designed to be correspondingly stable.

SUMMARY OF THE INVENTION

It is the object of the present invention to provide a new forming device of the type mentioned above which is improved particularly with respect to the expenditure required to safeguard the dimensional stability of the mold cavity.

The forming device, according to the invention, which meets this object is characterized in that the clamping device and/or the forming tool have/has at least one counter-clamping device which compensates at least partially for deformations of the mold cavity during forming.

In accordance with this solution according to the invention, a certain deformation of the clamping device and/or tool is taken into account, but compensating deformations are generated through the application of clamping force by one or more counter-clamping devices provided in the clamping device and/or in the tool, so that the mold cavity retains its shape to a great extent. Consequently, the clamping parts and tool parts can be produced with less stability at a lower cost of material while retaining the same manufacturing accuracy. The mass and weight of the forming device are accordingly also reduced as a whole in an advantageous manner.

While mechanical counter-clamping devices, e.g., having wedges, can be used, the counter-clamping device in a preferred embodiment form of the invention comprises a counter-pressure chamber.

The counter-pressure chamber can be acted upon by the working pressure, wherein a device used for applying pressure to the workpiece can also be advantageously used in addition for the counter-pressure chamber.

On the other hand, however, an additional device can be provided for the admission of pressure to the counter-pressure chamber, wherein this additional device makes it possible to generate in the counter-pressure chamber a counter-pressure which lies above or below the working pressure and which, e.g., depending on the respective arrangement of the tool or the formed article to be produced, could be adjusted with respect to an optimum compensation of mold cavity deformations.

In an embodiment form of the invention, the counter-pressure chamber is provided in a clamping jaw contacting the forming tool, wherein there can be provided, e.g., between the counter-pressure chamber and the tool, a relatively thin clamping jaw wall which curves under the influence of the counter-pressure against the tool and thus opposes a giving way of the clamping jaw and/or tool.

Alternatively, a short-stroke cylinder in which the counter-pressure chamber is formed could act on the clamping jaw on the side of the clamping jaw remote of the tool.

According to an especially preferred embodiment form of the invention, the clamping jaw rests against the forming tool by a part of the clamping jaw which is movable relative to the rest of the clamping jaw through the application of pressure to the counter-pressure chamber, wherein this movable part is formed in particular in the manner of a pressure piston guided in the clamping jaw. If the clamping jaw gives way under the influence of the forming applied to a workpiece, the clamping jaw piston is displaced correspondingly while maintaining a suitable pressure in the counter-pressure chamber, so that the tool part resting against it remains in the same location.

This embodiment form with a movable clamping jaw part is particularly advantageous in an internal high-pressure forming device in which the clamping jaw can be placed in clamping contact against the tool by a quarter-turn ring or bayonet ring, wherein a tool holder for the bayonet ring comprising a counter-clamping jaw forms a counter-bearing. Above all, the strength requirements for the locking parts of the bayonet closure, which consequently need to be constructed in a less solid manner, are made less exacting due to the possibility of compensation by means of the clamping jaw with the counter-pressure chamber.

In a further preferred embodiment form of the invention, the counter-pressure chamber, including a pressure connection channel, is provided with a sealing lining which can be formed in particular by a plastic membrane which fills up the counter-pressure chamber in a balloon-like manner. A flexible sealing lining of this type is especially advantageous in the above-mentioned embodiment form with a pressure-piston type clamping jaw part because, in this case, the pressure piston does not need to be specially sealed in its guide.

The invention will now be described with reference to an embodiment example and to the accompanying drawing relating to this embodiment example.

BRIEF DESCRIPTION OF THE DRAWING

The drawing is a sectional view showing an internal high-pressure forming device.

DESCRIPTION OF THE PREFERRED EMBODIMENTS

A cup-like tool holder with a base wall 2 and a vertical cylinder wall 3 is designated by 1 in the Figure. An opening 4 extending over a large portion of the wall surface is provided in the base wall 2. Openings 5 and 6 which are located opposite one another are formed in the cylinder wall 3.

A clamping jaw which engages with a bayonet ring 9 which is rotatable relative to it by a hydraulic cylinder 8 is designated by 7.

A clamping jaw counter-plate 10 supported on a shoulder formed by the remaining portion of the base plate 2 is arranged opposite the clamping jaw 7. A forming tool with an upper part 11 and a lower part 12 is arranged between the clamping jaw 7 and the clamping jaw counter-plate 10. A workpiece 13 which is formed by the forming of a pipe is located in the two-part formed article tool.

The clamping jaw 7 has an upper part 14 with an annular recess in which engages a ring land or annular web 15 which projects inward from the bayonet ring. Below the annular web 14, the clamping jaw 7 widens in diameter somewhat.

A lower part of the clamping jaw 7, designated by 16, has an upper portion which is guided in the manner of a pressure piston in a recess in the upper part 14 of the clamping jaw 7 and can rest against the underside of the upper part 14 of the clamping jaw by an annular shoulder 18. When the annular shoulder 18 rests against the underside of the upper part 14 of the clamping jaw, there remains a counter-pressure chamber 17 which is formed by the upper part 14 of the clamping jaw and the lower part 14 of the clamping jaw and which can be acted upon by fluid pressure via a connection channel 19. The counter-pressure chamber 17 and the connection channel 19 are lined by a sealing plastic membrane 20.

The bayonet ring 9 engages, by locking teeth 21 arranged at its circumference, in an annular recess 22 in the cylinder wall 3, wherein the locking teeth engage behind corresponding locking teeth 23 at the cylinder wall 3 in one rotational position. In another rotational position, the bayonet ring can be lifted up with the clamping jaw 7, wherein the locking teeth 21 of the bayonet ring 9 are guided between the locking teeth 23 at the cylinder wall 3.

Movable holders for pressure fluid supply lines 26 and 27 which can be applied to the workpiece 13 are designated by 24 and 25.

The counter-stops which limit the downward movement of the lower part 16 of the clamping jaw are not shown in the Figure.

The manner of operation of the device described above will be explained in the following.

In a state in which the bayonet closure with the clamping jaw 7 is raised from the cup-like tool holder 1, a clamping jaw counter-plate 10 suitable for the given instance of application is arranged on the base 2 of the tool holder 1. The lower part 12 of the tool, the workpiece 13 and the upper part 11 of the tool are then inserted.

To clamp the tool parts 11 and 12, the bayonet ring 9 with the clamping jaw 7 is initially lowered, wherein the locking teeth 21 of the bayonet ring 9 pass between locking teeth 23 at the upper edge of the cylinder wall 3 of the tool holder 1. The bayonet ring is then rotated by means of the hydraulic cylinder 8, wherein the teeth 21 of the bayonet ring 9 engage behind the locking teeth 23 at the cylinder wall 3. By means of a suitable beveling of the teeth, a pressing pressure of the clamping jaw 7 against the upper tool part 11 and a corresponding pressing counter-pressure via the tool holder 1 and the clamping jaw counter-plate 10 is transmitted to the lower part 12 of the tool.

For the forming of the workpiece, the fluid pressure supply lines 26 and 27 are applied to the tubular workpiece 13 in the manner shown in the Figure by means of sealing devices, not shown, and a fluid, in the present case, water, is introduced under pressure into the workpiece. At the same time, fluid is admitted to the counter-pressure chamber 17 under the same pressure.

Under the pressure of the fluid, the tubular workpiece deforms and lies against the mold walls of the tool parts 11 and 12 to an increasing degree, so that the pressing force which acts particularly in the vertical direction between the clamping jaw 7 and the upper tool part 11 and between the clamping jaw counter-plate 10 and the lower tool part 12 is increased. The clamping device formed by the tool holder 1 with the clamping jaw counter-plate 10 and the clamping jaw 7 is prevented from giving way, especially in the region of the bayonet ring 9, in that the counter-pressure prevailing in the counter-pressure chamber 17 displaces the lower part 18 of the clamping jaw downward for the purpose of compensation, which accordingly holds the workpiece parts so as to be stationary while maintaining constant the height of the mold cavity.

I claim:

1. An internal high-pressure forming device comprising a multiple-part forming tool defining a mold cavity, and a clamping device for holding the parts of the forming tool together against a deforming action, wherein at least the clamping device has at least one counter-clamping device with a counter-pressure chamber for compensating at least partially for deformations of the mold cavity during forming, and wherein the counter-pressure chamber is located in a clamping jaw mounted so as to rest against the forming tool.

2. The forming device according to claim 1, wherein the counter-pressure chamber is configured to operate with a working pressure of the forming device.

3. The forming device according to claim 1, comprising a device for applying adjustable pressure to the counter-pressure chamber, wherein the device for the application of pressure is independent from the working pressure.

4. The forming device according to claim 1, wherein the clamping jaw has a part configured to rest against the forming tool and movable relative to the clamping jaw by pressure admitted to the counter-pressure chamber.

5. The forming device according to claim 4, wherein the movable part of the clamping jaw comprises a portion in the form of a pressure piston guided in the clamping jaw.

6. The forming device according to claim 5, comprising a bayonet ring for pressing the clamping jaw against the forming tool, further comprising a forming tool holder for the bayonet ring, wherein the forming tool holder forms a counter-bearing and holds a counter-bearing clamping jaw.

7. The forming device according to claim 6, wherein the forming tool holder is comprised of a cup having a cup base, wherein the counter-clamping jaw rests against the cup base.

8. The forming device according to claim 1, wherein the counter-pressure chamber including a pressure connection channel is provided with a sealing lining.

9. The forming device according to claim 8, wherein the lining is comprised of a plastic membrane which fills out the counter-pressure chamber in a balloon-like manner.

10. An internal high-pressure forming device comprising a multiple-part forming tool defining a mold cavity, and a clamping device for holding the parts of the forming tool together against a deforming action, wherein at least the clamping device has at least one counter-clamping device with a counter-pressure chamber for compensating at least partially for deformations of the mold cavity during forming, and wherein at least one of the counter-pressure chamber and an additional counter-pressure chamber are formed in a short-stroke cylinder acting on a clamping jaw.

11. The forming device according to claim 10, wherein the counter-pressure chamber is configured to operate with a working pressure of the forming device.

12. The forming device according to claim 10, comprising a device for applying adjustable pressure to the counter-pressure chamber, wherein the device for the application of pressure is independent from the working pressure.

13. The forming device according to claim 10, wherein the clamping jaw has a part configured to rest against the forming tool and movable relative to the clamping jaw by pressure admitted to the counter-pressure chamber.

14. The forming device according to claim 13, wherein the movable part of the clamping jaw comprises a portion in the form of a pressure piston guided in the clamping jaw.

15. The forming device according to claim 14, comprising a bayonet ring for pressing the clamping jaw against the forming tool, further comprising a forming tool holder for the bayonet ring, wherein the forming tool holder forms a counter-bearing and holds a counter-bearing clamping jaw.

16. The forming device according to claim 15, wherein the forming tool holder is comprised of a cup having a cup base, wherein the counter-clamping jaw rests against the cup base.

17. The forming device according to claim 10, wherein the counter-pressure chamber including a pressure connection channel is provided with a sealing lining.

18. The forming device according to claim 17, wherein the lining is comprised of a plastic membrane which fills out the counter-pressure chamber in a balloon-like manner.

* * * * *